US005367735A

United States Patent [19]

Mosier et al.

[11] Patent Number: 5,367,735

[45] Date of Patent: Nov. 29, 1994

[54] WEIGHTED INSERT FOR FOOTWEAR

[76] Inventors: Sandra N. Mosier; Dan L. Mosier, both of 6401 S. 66th St., both of Lincoln, Nebr. 68516

[21] Appl. No.: 979,907

[22] Filed: Nov. 23, 1992

[51] Int. Cl.[5] ..... A43D 3/00

[52] U.S. Cl. ..... 12/128 B; 12/128 R

[58] Field of Search ..... 12/114.2, 117.4, 128 R, 12/128 B, 128 H, 115.6, 133 A, 133 M, 135 A; 206/77.1, 0.5; 68/17 R

[56] References Cited

U.S. PATENT DOCUMENTS

| | | | |
|---|---|---|---|
| 1,521,950 | 1/1925 | Hilker | 12/117.4 |
| 1,849,752 | 3/1932 | Conner | 12/117.4 |
| 2,010,146 | 8/1935 | Garson | 12/128 B |
| 2,446,904 | 8/1948 | Brush | 12/128 B |
| 2,460,405 | 2/1949 | Abrams et al. | 12/128 B |
| 2,510,315 | 6/1950 | Malberg | 12/128 B |
| 2,975,444 | 3/1961 | Drew | 12/128 R |
| 3,899,073 | 8/1975 | Barr | 206/77.1 |
| 5,230,115 | 7/1993 | Hollister et al. | 12/128 B |

FOREIGN PATENT DOCUMENTS 290332 11/1988 European Pat. Off. .

*Primary Examiner*—Paul T. Sewell
*Assistant Examiner*—Thomas P. Hilliard
*Attorney, Agent, or Firm*—S. Michael Bender

[57] ABSTRACT

A weighted insert adapted to be fitted inside an athletic shoe so that the latter is caused to sink to the bottom of a washing machine bin to facilitate the cleaning thereof. The insert comprises a heel portion, a foot portion, and an axial member extending therebetween. The length or longitudinal extent of the axial member may be adjusted to compensate for varying sized athletic shoes to be employed therewith. In an alternative embodiment, at least one of the weighted elements in the heel portion or the foot portion of the insert comprises a removable housing for a deodorizing compound or similar treating substance.

9 Claims, 4 Drawing Sheets

WEIGHTED INSERT FOR FOOTWEAR

BACKGROUND OF THE INVENTION

1. Field of the Invention

The present invention relates generally to footwear appliances, and more particularly, to a weighted insert for athletic shoes and the like which when fitted to the shoe will cause it to sink to the bottom of a washing machine bin to facilitate the cleaning thereof.

2. Description of the Prior Art

It is well known to affix weights to a sneaker or other athletic shoe for the purpose of enhancing exercising or strengthening of the legs. For Example, U.S. Pat. No. 4,777,743 shows a weighted collar affixed to a sneaker, athletic or leisure shoe for increasing the resistance which the user must overcome during training or exercising. A similar concept is disclosed in U.S. Pat. No. 4,458,432 which contemplates pockets on the toe portion and/or sides of a sneaker for receiving removable weights therein. In U.S. Pat. No. 3,51,928 a series of weights are permanently embedded in separate compartments in the sole of a training shoe whereas in U.S. Pat. No. Des. 310,441 there is illustrated a sneaker having weights permanently attached to the upper or vamp thereof.

It is also well known to provide inserts for shoes and the like the purpose of which is to treat the shoe in one way or another. For example, the familiar shoe-form or "tree" is employed to maintain the shape of an article of footwear when it is not being worn. Similarly, U.S. Pat. No. 4,984,327 discloses a holder having heel and toe portions connected by an arcuately shaped handle portion for supporting a shoe while it is being dyed.

It is apparent that the foregoing body of prior art fails to envision the concept of fitting a weighted insert to a sneaker, athletic shoe, or the like, for causing the shoe to sink to the bottom of a washing machine bin (rather than float on the surface of the water therein in the absence of such an insert) and thereby facilitate more efficient cleaning of the shoe than would otherwise be the case. Nor does the prior art described above teach or suggest a weighted insert for athletic shoes or the like which includes a removable weighted element serving also as a housing for a deodorizing compound or other treating substance. The foregoing disadvantages are overcome by the unique weighted insert for articles of footwear according to the present invention as will be made apparent from the following description thereof. Other advantages of the present invention over the prior art also will be rendered evident.

SUMMARY OF THE INVENTION

To achieve the foregoing and other advantages, the present invention, briefly described, provides a weighted insert adapted to be fitted inside an athletic shoe so that the latter is caused to sink to the bottom of a washing machine bin to facilitate the cleaning thereof. The insert comprises a heel portion, a foot portion, and an axial member extending therebetween. The length or longitudinal extent of the axial member may be adjusted to compensate for varying sized athletic shoes to be employed therewith. In an alternative embodiment, at least one of the weighted elements in the heel portion or the foot portion of the insert comprises a removable housing for a deodorizing compound or similar treating substance.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least two preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved weighted insert for footwear which has all of the advantages of the prior art and none of the disadvantages.

It is another object of the present invention to provide a new an improved weighted insert for footwear which may be easily and efficiently manufactured and marketed.

It is a further objective of the present invention to provide a new and improved weighted insert for footwear which is of durable and reliable construction.

An even further object of the present invention is to provide a new and improved weighted insert for footwear which is susceptible of a low cost of manufacture with regard to both materials and labor, and which accordingly is then susceptible of low prices of sale to the consuming public, thereby making such weighted insert for footwear available to the buying public.

Still yet a further object of the present invention is to provide a new and improved weighted insert for footwear which causes the shoe with which it is fitted to sink to the bottom of a washing machine bin and thereby facilitate cleaning thereof.

It is still a further object of the present invention is to provide a new and improved weighted insert for footwear which includes means for adjusting the size thereof to fit shoes or other articles of footwear of varying size.

Still a further object of the present invention is to provide a new and improved weighted insert for footwear including means for housing a deodorant compound or other treatment substance.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

Figure 1:
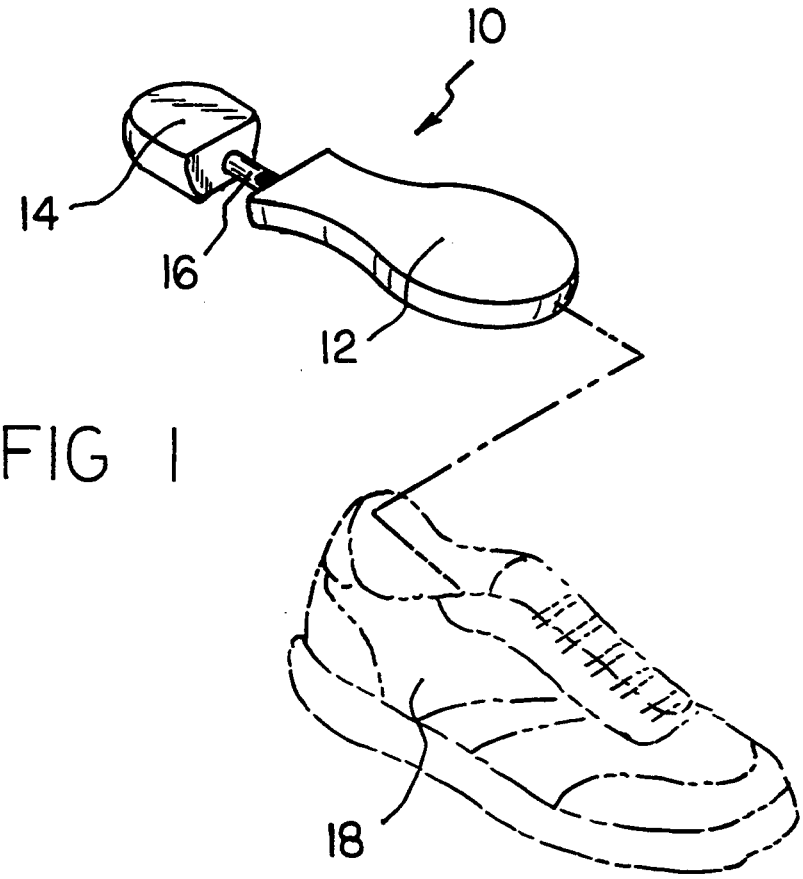
FIG. 1 is a perspective view showing the first preferred embodiment of the weighted insert for footwear of the invention.

With reference now to the drawings, a new and improved weighted insert for footwear embodying the principles and concepts of the present invention will be described.

Turning initially to FIGS. 1–4, there is shown a first exemplary embodiment of the weighted insert for footwear of the invention generally designated by reference numeral 10. In its preferred form, insert 10 comprises a first portion 12 generally in the shape of the front part or sole of the foot, and a second portion 24 generally in the shape of a heel, and a connecting portion preferably a cylindrical rod 16. Insert 10 thus is generally in the shape of a human foot and is adapted to be placed inside a conventional sneaker, athletic shoe or the like 18 as diagrammatically indicated in FIG. 1. In accordance with the present invention, insert 10 is weighted in a manner to be more fully described below so that when it is placed inside sneaker 18, the latter will sink to the bottom of a conventional washing machine bin and remain there during the wash and spin cycle of the machine thereby to more effectively clean the sneaker than would otherwise be the case with an unweighted sneaker which would tend to float to the top of a washing machine bin.

Figure 2:
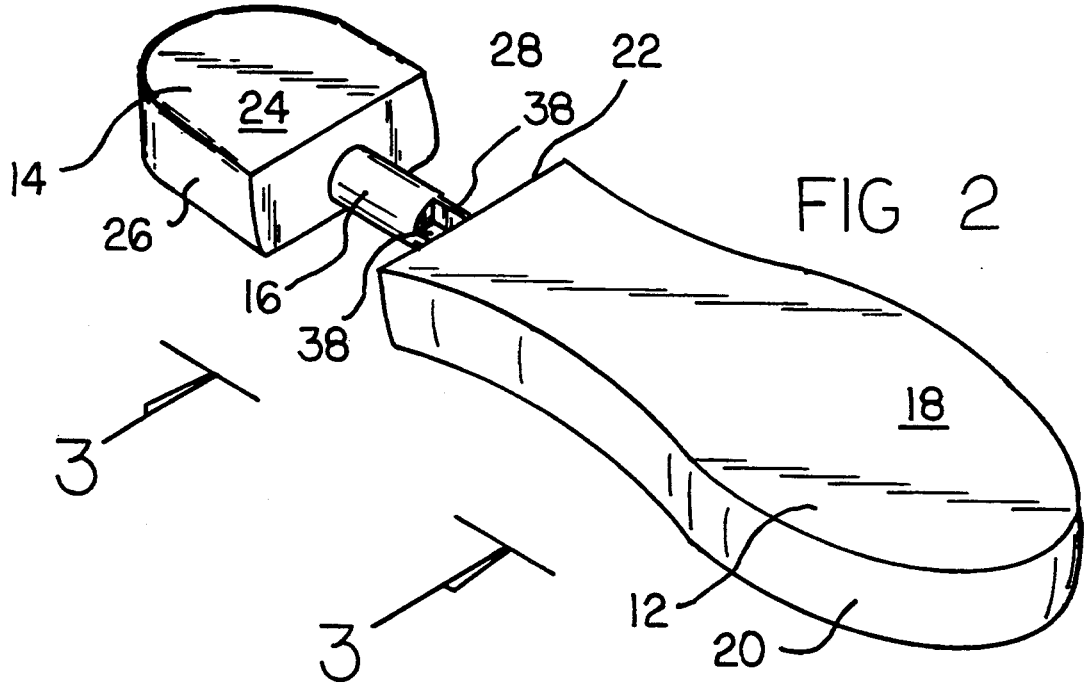
FIG. 2 is an enlarged elevational view in perspective of the weighted insert for footwear shown in FIG. 1.
Figure 3:
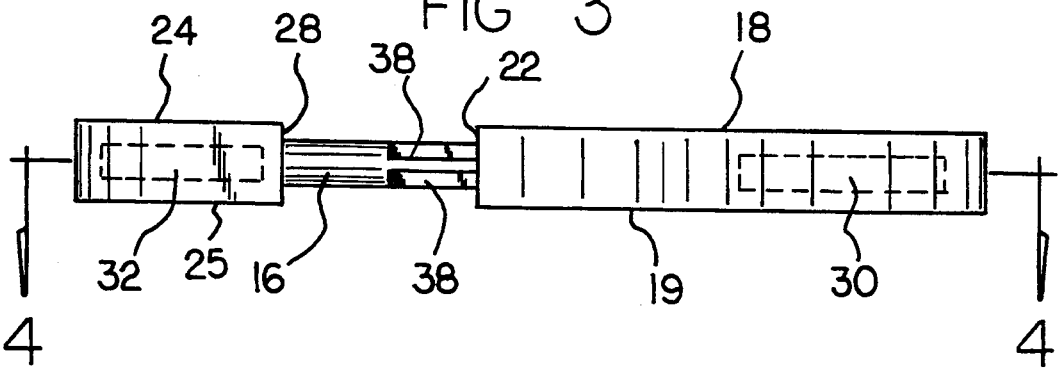
FIG. 3 is a side elevational view of the weighted insert for footwear of FIG. 2 taken along line 3—3 thereof.
Figure 4:
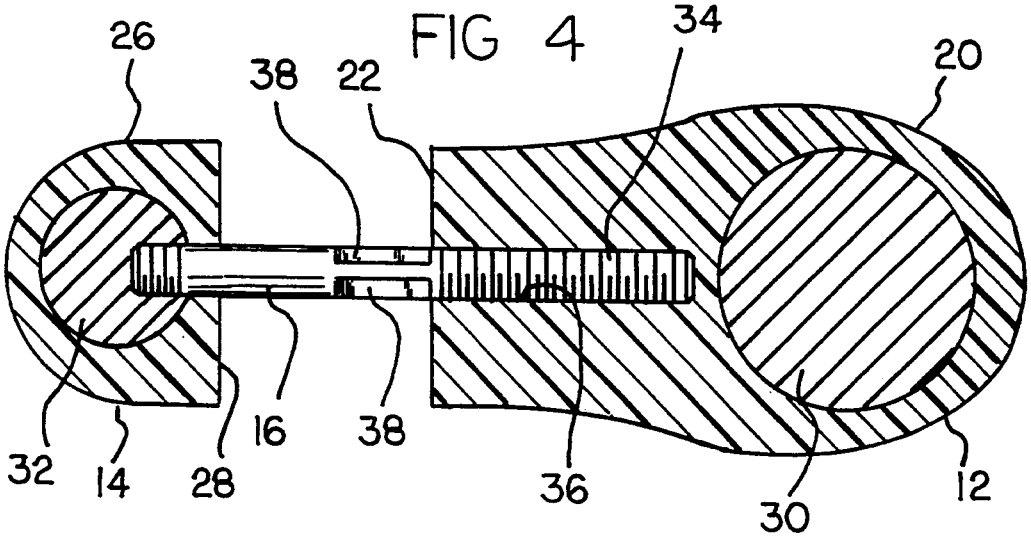
FIG. 4 is a cross-sectional plan view taken along line 4—4 of FIG. 3.

More specifically, and with reference now to FIGS. 2 through 4, the first portion 12 of insert 10 has substantially flat top and bottom opposed surfaces 18, 19, a curvilinear peripheral side edge 20, and a rear side edge 22 whereas the second portion 14 of insert 10 has substantially flat top and bottom opposed surfaces 24, 25, a curvilinear peripheral side edge 26 and a forward side edge 28 substantially as shown. A first weight element in the form of a disk 30 which preferably is of metallic material is suitably embedded in the forward or rightmost section of portion 12 as best seen in FIGS. 3 and 4. Similarly, a second weight element in the form of a disk 32 also preferably of metallic material is suitably embedded in the heel portion 14. Integrally connected to disk 32 and extending longitudinally therefrom through flat edge 28 is a cylindrical connecting rod 16. Rod 16 preferably is affixed to disk 32 by suitable means, preferably complimentary threaded mating surfaces on the left end of the rod and in a suitable blind hole in the side edge of disk 32, respectively (FIG. 4). The other or opposed end 34 of rod 16 is threaded in such a manner as to be matingly engaged in a complimentary threaded recess 36 in portion 12 extending axially and longitudinally from rear side edge 22 toward disk 30. A plurality of notches each designated by reference numeral 38 and preferably four in number, are equally spaced about the circumferential extent of rod 16 substantially intermediately thereof to facilitate gripping and rotating of rod 16 by the fingers of the hand.

By this arrangement, the axial or longitudinal distance between portions 12 and 14 may be varied by rotating rod 16 and portion 14 relative to portion 12 and causing rod end 34 to advance or back-off in recess 36. In this manner, a single sized insert 10 may be adjusted to fit a wide variety of different sized sneakers, athletic shoes, or the like. In actual practice, it is preferred that two sizes of insert 10 be employed, one suited for adult sized shoes and the other, a smaller scale version, suited for children sized shoes.

The preferred material for portions 12 and 14 of insert 10 is a molded or otherwise formed polymeric substance that is inert when placed in a washing machine environment and will maintain its dimensional stability when exposed to the elevated temperature of a conventional washing machine cycle. A wide range of plastic materials meeting these requirements and which may easily be molded or formed about disks 30, 32 and rod 16 in the configuration shown are commercially available including, but not limited to polypropylene, polyurethane, or acrylic polymerie compounds. Disks 12, 14 preferably are fabricated of aluminum, but other rustproof metals or metal alloys may be employed instead including, but not limited to bronze, brass, and so on. In addition, although disks 12, 14 are preferably solid to provide sufficient weight to overcome the buoyancy of an average sneaker, these disks may be hollow or donut shaped, if desired, as long as the total weight of the insert is great enough to sink the sneaker or other shoe it is employed with and maintain the sneaker on or near the bottom of a conventional washing machine bin during the latter's wash cycle.

In operation, the insert is adjusted to fit snugly inside a sneaker or other shoe to be washed in a washing machine (or in any other washing facility) by suitably adjusting the longitudinal separation of portions 12 and 14. This is accomplished, as described above, by merely rotating the connecting rod 16 relative to first portion 12 preferably by grasping the rod's notches 38 with fingers of one hand and holding the first portion 12 with the other hand. Because the insert is shaped to resemble a foot, a correctly adjusted insert should snugly engage the front and rear interior portions of the sneaker. If desired, axial adjustment of the insert may take place after the insert is placed inside the sneaker as this will assure a snug fit. Also, the laces of the sneaker, if any, may be may be tied after insertion. The combination of the shoe and the insert may then be placed in a washing machine for cleaning in the same manner as an article of clothing, for example. Owing to the presence of the weighted insert 10, the sneaker being washed will remain submerged near the bottom of the washing machine's bin during the washing cycle and will thereby effect complete cleaning thereof. The actual weight of insert 10 must be sufficient to negate the buoyancy of a canvas or leather shoe in water. Generally speaking, and without limiting the invention, a total dead weight per insert in the range of 6 to 12 ounces should be sufficient to sink most sneakers, athletic shoes or the like and maintain same near the bottom of the washing machine bin as contemplated herein.

It is within the contemplation of the present invention to utilize one or more of the weight disks as storage means for a substance for treating the host sneaker or other shoe. Thus, there is shown in FIGS. 5 through 8 an alternatively preferred form of the invention wherein like reference numerals represent like parts already described, and wherein such storage means are embodied.

Figure 5:
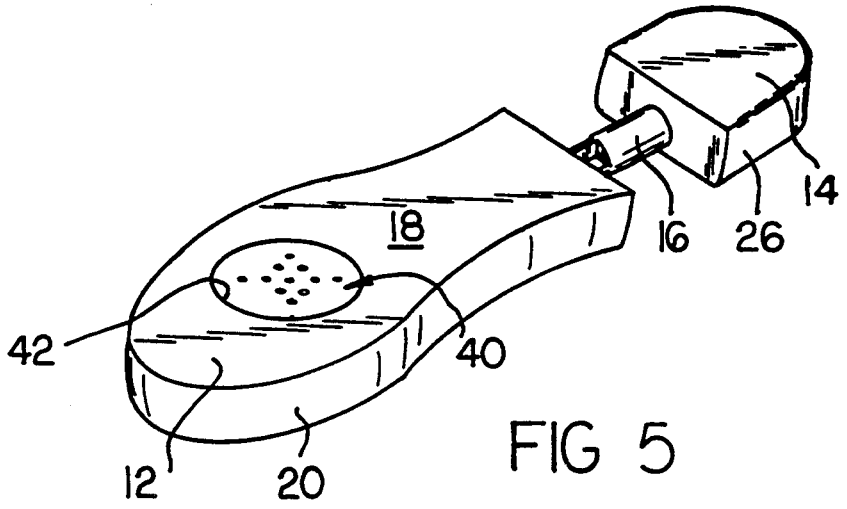
FIG. 5 is a perspective view showing the second preferred embodiment of the invention.
Figure 6:
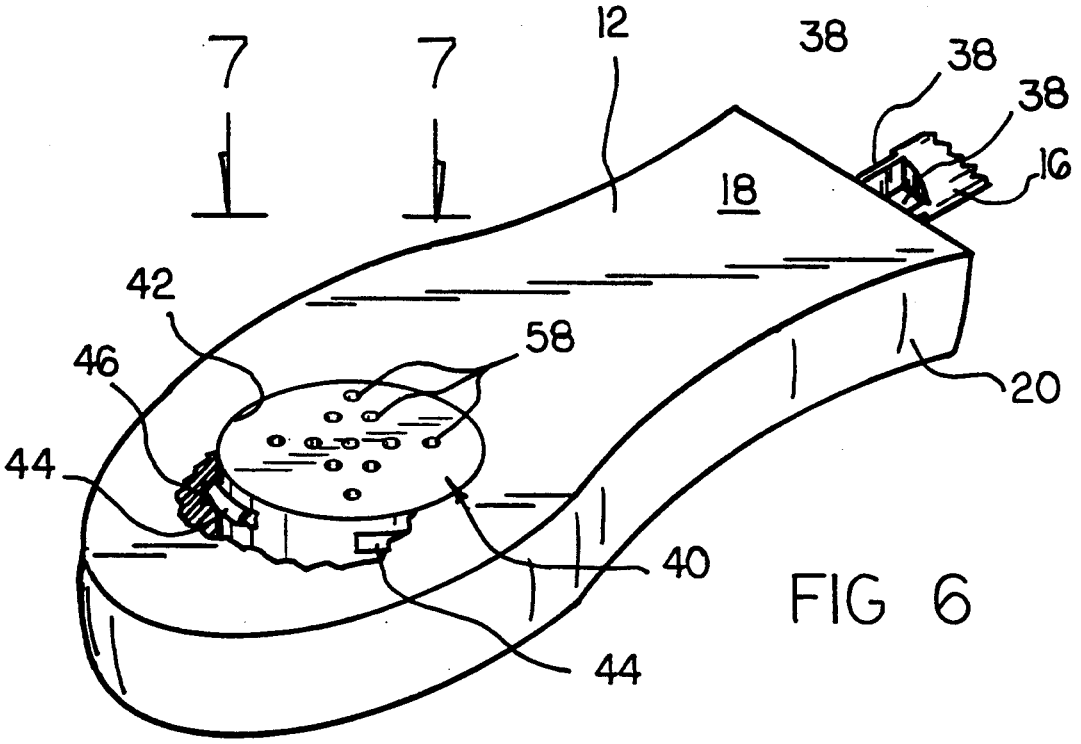
FIG. 6 is an enlarged perspective view of a portion of the embodiment illustrated in FIG. 5.
Figure 7:
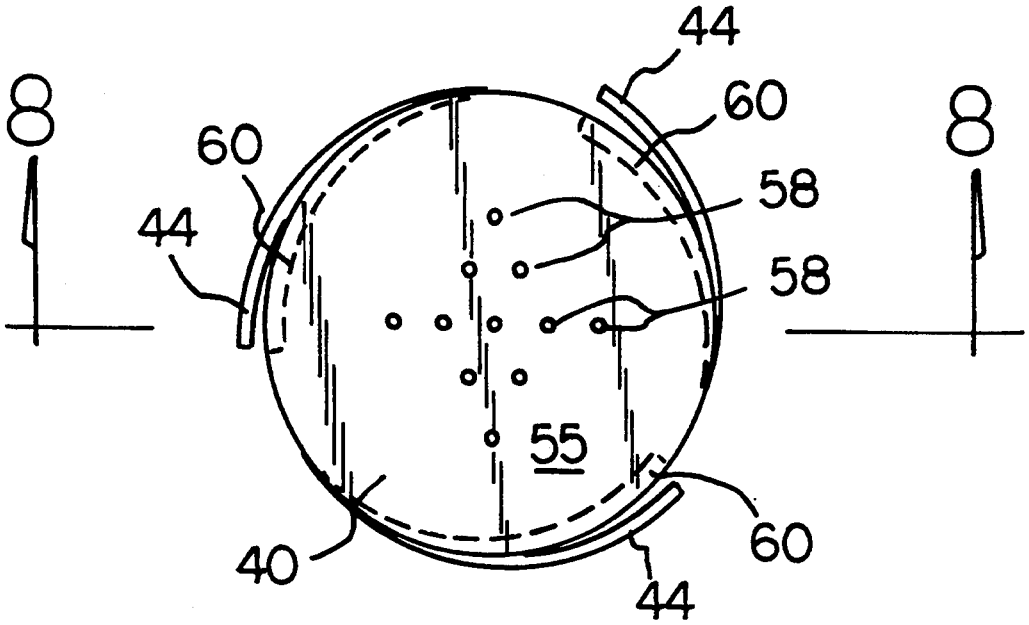
FIG. 7 is a plan view of the weighted element of the alternatively preferred second embodiment of the invention of FIGS. 5 and 6.
Figure 8:
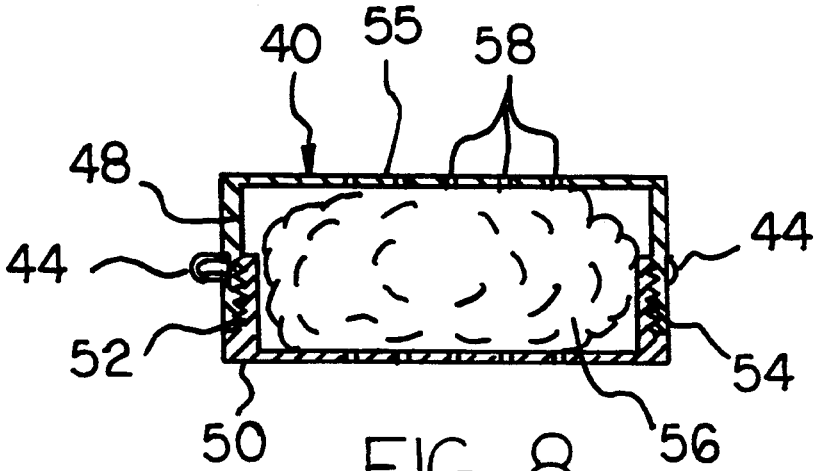
FIG. 8 is a cross-sectional view of the weighted element of FIG. 7 taken along line 8—8 thereof.

Turning initially to FIG. 5, a modified weight providing disk 40 is disposed in portion 12 within a recess 42 therein substantially as depicted. As better viewed in FIGS. 7 and 8, disk 40 comprises a hollow cylindrical canister having a top portion 48 rotatably connected to a bottom portion 50 by means of complimentary mating threads 52, 54 on each portion, respectively. The upper wall 55 of top portion 48 includes a plurality of small holes 58 through which a conventional deodorizing powder 56 stored interiorly of canister/disk 40 may leach out during the washing machine cycle. Canister 40 is removably attached to portion 12 via a plurality of arcuate cantilevered spring fingers each designated by reference numeral 44 equally spaced about the periphery of the canister top portion side edge as clearly shown in FIG. 7, and a like plurality of grooves 46 equally circumferentially spaced about the side surface of recess 42. Hence, canister/disk 40 may be retained in position in recess 42 preferably with its upwardly facing surface 55 flush with respect to the upper flat surface 18 of portion 12 by pressing the canister into the recess and rotating the canister in a clockwise direction until springs 44 snap into grooves 46. Selective removal of canister 40 is achieved in a similar manner, i.e. the by rotating the canister in recess 42 in a clockwise direction until the side wall of recess 42 cams springs 44 radially inwardly sufficient to cause the springs to seat within corresponding notches each designated by reference numeral 60 provided in the outer side wall surface of canister top portion 48 (FIG. 7). The insert may then easily be removed from recess 42 for purposes of refilling the interior compartment of canister 40 with a fresh charge of deodorizing compound. Of course, it will be appreciated that other sneaker or shoe fabric treating compounds may be employed in lieu of or in combination with deodorizing substance 56 such as for example, detergent, bleach, coloring or softening agents, etc.

It is apparent from the above that the present invention accomplishes all of the objectives set forth by providing a new and improved weighted insert for footwear which causes the shoe with which it is fitted to sink to the bottom of a washing machine bin and thereby facilitate cleaning thereof, and further by providing a new and improved weighted insert for footwear which includes means for adjusting the size thereof to fit shoes or other articles of footwear of varying size, as well as optional means for housing a deodorant compound or other treatment substance.

With respect to the above description, it should be realized that the optimum dimensional relationships for the parts of the invention, to include variations in size, weight, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved weighted insert for footwear comprising:

a first portion generally in the shape of the sole of a human foot, a second portion generally in the shape of the heel of a human foot, means for connecting said first and second portions in a juxtaposed longitudinal manner, and means for weighting at least one of said first or second portions such that said insert is adapted to be placed into an article of footwear to cause said article of footwear to have negative buoyancy in water, wherein said means for weighting comprises a metal disk embedded in said first portion, wherein said metal disk includes means for removably retaining said disk in said first portion, wherein said removable disk is cylindrically shaped and said retaining means comprises a cylindrically shaped recess in said first portion for receiving said disk therein and a plurality of resilient detents on said disk adapted to engage a plurality of retaining grooves in the wall surface of said recess when said disk is inserted into said recess.

2. The invention of claim 1 wherein said means for connecting includes means for adjustably varying the longitudinal spacing between said first and said second portions.

3. The invention of claim 2 wherein said means for adjustably varying comprises a rod extending longitudinally between said first and second portions and having opposed ends, and threaded receptacle means for attaching said first portion to one of said ends of said rods.

4. The invention of claim 3 wherein said means for varying the attachment point comprises a threaded surface on said one end of said rod and a complimentary threaded surface on the wall of a recess on said first portion, said recess extending longitudinally with respect to said first portion and being adapted to matingly receive therein said one end of said rod.

5. The invention of claim 4 wherein said rod further includes gripping means located intermedially of the opposed ends of said rod, said gripping means adapted to facilitate rotation of said rod relative to said first portion to cause said one end of said rod to matingly engage said recess on said first portion to thereby vary the attachment point thereof.

6. The invention of claim 3 wherein said means for weighting comprises a metal disk embedded in said second portion.

7. The invention of claim 3 wherein said means for weighting comprises a pair of metal disks embedded in said first and second portions, respectively.

8. The invention of claim 1 wherein said removable disk has first and second mating sections defining a hollow enclosure, at least one of said sections having passage means therein wherein a footwear treating substance stored in said hollow enclosure is adapted to exit said enclosure through said passage means.

9. A new and improved weighted insert for footwear comprising:

a first portion generally in the shape of the sole of a human foot, a second portion generally in the shape of the heel of a human foot, means for connecting said first and second portions in a juxtaposed longitudinal manner, and means for weighting at least one of said first or second portions such that said insert is adapted to be placed into an article of footwear to cause said article of footwear to have negative buoyancy in water, wherein said means for connecting includes means for adjustably varying the longitudinal spacing between said first and said second portions, wherein said means for adjustably varying comprises a rod extending longitudinally between said first and second portions and having opposed ends, and threaded receptacle means for attaching said first portion to one of said ends of said rod, wherein said means for weighting comprises a pair of metal disks embedded in said first and second portions, respectively, and wherein said rod is rotatably attached to one of said pair of metal disks in said second portion, and said rod is longitudinally spaced from the other of said pair of metal disks in said first portion respectively, and said first and second portions comprise a solid polymeric substance molded about said metal disks, respectively.

* * * * *